US010683156B2

(12) United States Patent
Lai et al.

(10) Patent No.: US 10,683,156 B2
(45) **Date of Patent: *Jun. 16, 2020**

(54) MICROWAVE HEATING CONTAINER

(71) Applicant: Graphic Packaging International, LLC, Atlanta, GA (US)

(72) Inventors: Laurence M. C. Lai, Mississauga (CA); Sandra M. Tsontzidis, Brampton (CA); Bing Liu, Mississauga (CA); Angela Chen Li, Milton (CA); Neilson Zeng, North York (CA)

(73) Assignee: Graphic Packaging International, LLC, Atlanta, GA (US)

( * ) Notice: Subject to any disclaimer, the term of this patent is extended or adjusted under 35 U.S.C. 154(b) by 397 days.

This patent is subject to a terminal disclaimer.

(21) Appl. No.: 15/278,565

(22) Filed: Sep. 28, 2016

(65) Prior Publication Data

US 2017/0015486 A1 Jan. 19, 2017

Related U.S. Application Data

(62) Division of application No. 12/499,892, filed on Jul. 9, 2009, now Pat. No. 9,493,287.

(Continued)

(51) Int. Cl.
*B65D 81/34* (2006.01)
*H05B 6/64* (2006.01)

(52) U.S. Cl.
CPC ..... *B65D 81/3453* (2013.01); *H05B 6/6408* (2013.01); *B65D 2581/3466* (2013.01);

(Continued)

(58) Field of Classification Search
CPC ..... B65D 81/34; B65D 81/3446; B65D 81/3453; B65D 2581/344;

(Continued)

(56) References Cited

U.S. PATENT DOCUMENTS 3,865,301 A 2/1975 Pothier et al.
4,703,148 A 10/1987 Mikulski (Continued)

FOREIGN PATENT DOCUMENTS

EP 0 382 399 A2 8/1990
JP 2005-211090 A 8/1993

(Continued)

OTHER PUBLICATIONS

International Search Report—PCT/US2008/051056, dated May 13, 2008, Graphic Packaging International, Inc.

(Continued)

*Primary Examiner* — Dana Ross
*Assistant Examiner* — Ayub A Maye
(74) *Attorney, Agent, or Firm* — Womble Bond Dickinson (US) LLP

(57) ABSTRACT

A microwave heating construct comprises a base, a wall extending upwardly around the base for defining a cavity for receiving a food item, and a microwave energy shielding element overlying a lower margin of the wall, the microwave energy shielding element having an upper edge including a substantially incurved portion.

21 Claims, 4 Drawing Sheets

Related U.S. Application Data

(60) Provisional application No. 61/134,619, filed on Jul. 11, 2008.

(52) U.S. Cl.
CPC ..... *B65D 2581/3472* (2013.01); *B65D 2581/3478* (2013.01); *B65D 2581/3479* (2013.01); *B65D 2581/3485* (2013.01); *B65D 2581/3491* (2013.01); *B65D 2581/3493* (2013.01); *Y10T 29/49* (2015.01)

(58) Field of Classification Search
CPC .... B65D 2581/3441; B65D 2581/3452; B65D 2581/3464
USPC ..... 219/725, 728, 729, 759, 730
See application file for complete search history.

(56) References Cited

U.S. PATENT DOCUMENTS

| | | | | |
|---|---|---|---|---|
| 4,775,771 | A | 10/1988 | Pawlowski | |
| 4,865,921 | A | 9/1989 | Hollenberg | |
| 4,890,439 | A | 1/1990 | Smart | |
| 4,927,991 | A | 5/1990 | Wendt et al. | |
| 4,936,935 | A | 6/1990 | Beckett | |
| 4,963,424 | A | 10/1990 | Beckett | |
| 4,972,059 | A | 11/1990 | Wendt et al. | |
| 5,039,364 | A | 8/1991 | Beckett | |
| 5,117,078 | A * | 5/1992 | Beckett | B65D 81/3453 219/728 |
| 5,213,902 | A | 5/1993 | Beckett | |
| 5,221,419 | A | 6/1993 | Beckett | |
| 5,260,537 | A | 11/1993 | Beckett | |
| 5,266,386 | A | 11/1993 | Beckett | |
| RE34,683 | E | 8/1994 | Maynard | |
| 5,340,436 | A | 8/1994 | Beckett | |
| 5,354,973 | A | 10/1994 | Beckett | |
| 5,370,883 | A | 12/1994 | Saunier | |
| 5,410,135 | A | 4/1995 | Pollart | |
| 5,424,517 | A | 6/1995 | Habeger | |
| 5,519,195 | A | 5/1996 | Keefer | |
| 5,593,610 | A | 1/1997 | Minerich et al. | |
| 5,628,921 | A | 5/1997 | Beckett | |
| 5,672,407 | A | 9/1997 | Beckett | |
| 5,698,127 | A | 12/1997 | Lai et al. | |
| 5,759,422 | A | 6/1998 | Schmelzer | |
| 5,800,724 | A | 9/1998 | Habeger | |
| 6,102,281 | A | 8/2000 | Lafferty et al. | |
| 6,114,679 | A | 9/2000 | Lai | |
| 6,150,646 | A | 11/2000 | Lai et al. | |
| 6,204,492 | B1 | 3/2001 | Zeng et al. | |
| 6,251,451 | B1 | 6/2001 | Zeng | |
| 6,414,290 | B1 | 7/2002 | Cole | |
| 6,433,322 | B2 | 8/2002 | Zeng et al. | |
| 6,455,827 | B2 | 9/2002 | Zeng | |
| 6,552,315 | B2 | 4/2003 | Zeng et al. | |
| 6,677,563 | B2 | 1/2004 | Lai | |
| 6,717,121 | B2 | 4/2004 | Zeng | |
| 6,765,182 | B2 | 7/2004 | Cole | |
| 7,476,830 | B2 | 1/2009 | Middleton et al. | |
| 8,803,049 | B2 | 8/2014 | O'Hagan et al. | |
| 8,847,132 | B2 * | 9/2014 | Russell | H05B 6/6411 219/730 |
| 2003/0085223 | A1 | 5/2003 | Zeng et al. | |
| 2003/0111463 | A1 | 6/2003 | Lai | |
| 2006/0049190 | A1 | 3/2006 | Middleton | |
| 2007/0194012 | A1 * | 8/2007 | Middleton | B65D 5/4204 219/730 |
| 2007/0215611 | A1 | 9/2007 | O'Hagan | |
| 2009/0223951 | A1 | 9/2009 | Lai et al. | |
| 2009/0294439 | A1 | 12/2009 | Lai et al. | |
| 2012/0100265 | A1 * | 4/2012 | Lafferty | B65D 81/3453 426/107 |

FOREIGN PATENT DOCUMENTS

| | | | |
|---|---|---|---|
| JP | 10-72068 | | 3/1998 |
| JP | 2000-018595 | | 1/2000 |
| JP | 2000-018595 | A | 1/2000 |
| JP | 2001-278362 | | 10/2001 |
| JP | 2001-278362 | A | 10/2001 |
| JP | 2005-512902 | | 5/2005 |
| JP | 2005-211090 | | 8/2005 |
| WO | WO 91/11893 | A1 | 8/1991 |
| WO | WO 03/053106 | A1 | 6/2003 |
| WO | WO 2006/110685 | A2 | 10/2006 |
| WO | WO 2007/106353 | A2 | 9/2007 |
| WO | WO 2007/113545 | A1 | 10/2007 |
| WO | WO 2008/091760 | | 7/2008 |
| WO | WO 2010/006098 | A2 | 1/2010 |

OTHER PUBLICATIONS

Written Opinion—PCT/US2008/051056, dated May 13, 2008, Graphic Packaging International, Inc.
International Preliminary Report on Patentability—PCT/US2008/051056, dated Aug. 6, 2009, Graphic Packaging International, Inc.
International Preliminary Report on Patentability—PCT/US2009/050004, dated Jan. 20, 2011, Graphic Packaging International, Inc.
International Search Report—PCT/US2009/050004, dated Feb. 24, 2010, Graphic Packaging International, Inc.
Written Opinion—PCT/US2009/050004, dated Feb. 24, 2010, Graphic Packaging International, Inc.
Supplementary European Search Report for EP 09 79 5153 dated Mar. 22, 2012.
European Search Report for EP 12 00 0101 dated Apr. 16, 2012.
European Search Report for EP 14 00 0135 dated Feb. 28, 2014.
Notice of Allowance and Fee(s) Due—U.S. Appl. No. 12/493,486 dated Mar. 11, 2014.
Notice of Reason for Rejection for JP 2011-517590 dated Nov. 20, 2012, and English translation.
Office Action for U.S. Appl. No. 12/499,892 dated May 6, 2013.
Response to Restriction Requirement and Amendment for U.S. Appl. No. 12/499,892 dated May 16, 2013.
Office Action for U.S. Appl. No. 12/499,892 dated Sep. 18, 2013.
Response to Office Action and Amendment Pursuant to 37 C.F.R. § 1.111 for U.S. Appl. No. 12/499,892 dated Dec. 17, 2013.
Office Action for U.S. Appl. No. 12/499,892 dated Apr. 10, 2014.
Request for Continued Examination (RCE) Transmittal for U.S. Appl. No. 12/499,892 dated Jul. 9, 2014.
Amendment and Response for U.S. Appl. No. 12/499,892 dated Jul. 9, 2014.
Office Action for U.S. Appl. No. 12/499,892 dated Feb. 18, 2015.
Response to Office Action for U.S. Appl. No. 12/499,892, filed May 18, 2015.
Office Action for U.S. Appl. No. 12/499,892 dated Jun. 1, 2015.
Request for Continued Examination (RCE) Transmittal for U.S. Appl. No. 12/499,892 dated Aug. 31, 2015.
Amendment and Response for U.S. Appl. No. 12/499,892 dated Aug. 31, 2015.
Office Action for U.S. Appl. No. 12/499,892 dated Jan. 15, 2016.
Response to Office Action for U.S. Appl. No. 12/499,892 dated Mar. 17, 2016.
Notice of Allowance and Fee(s) Due for U.S. Appl. No. 12/499,892 dated Jun. 29, 2016.
Issue Fee Transmittal for U.S. Appl. No. 12/499,892 dated Sep. 28, 2016.
Issue Notification for U.S. Appl. No. 12/499,892 dated Oct. 26, 2016.

* cited by examiner

MICROWAVE HEATING CONTAINER

CROSS-REFERENCE TO RELATED APPLICATIONS

This application is a divisional of U.S. patent application Ser. No. 12/499,892, filed Jul. 9, 2009, which claims the benefit of U.S. Provisional Application No. 61/134,619, filed Jul. 11, 2008, which is incorporated by reference herein in its entirety.

INCORPORATION BY REFERENCE

The disclosures of U.S. patent application Ser. No. 12/499,892, which was filed on Jul. 9, 2009, and U.S. Provisional Patent Application No. 61/134,619, which was filed on Jul. 11, 2008, are hereby incorporated by reference for all purposes as if presented herein in their entirety.

BACKGROUND

It is known that microwave ovens may have "hot spots", that is, areas in which the microwaves are concentrated and may become amplified, thereby causing a food item in the hot spot to become intensely heated. A single operating mode microwave oven may have only one hot spot in a single, constant location in the microwave oven, while a multiple operating mode microwave oven may have multiple hot spots in various places in the microwave oven at different points in time, thereby reducing the effect of each individual hot spot over the duration of the heating cycle. In many instances, the microwave oven may be provided with a turntable to attempt to mitigate the effect of such hot spots by continuously rotating the food item (and container, where applicable) to distribute the effect of the hot spots over various portions of the food item. However, in other instances, the microwave oven may be designed to utilize such hot spots advantageously with no attempt to mitigate the effect of the hot spot, for example, by specifying to the user which areas of the microwave oven will heat a food item most rapidly (e.g., a beverage).

It also is known that some microwave heating containers that include one or more microwave energy interactive elements may inherently have "hot spots", that is, areas that are more prone to overheating under certain microwave heating conditions. For example, some microwave heating containers include a microwave energy shielding element to prevent the overheating of particularly vulnerable areas of food item, such as the sides and peripheral margin of the bottom of the food item. Depending on the shape of the shielding element, the food item being heated, the length of the heating cycle, the type of microwave oven, and so on, some areas of the container adjacent to the shielding element may be more prone to scorching than other areas of the container.

The combined effect of the hot spots in the microwave oven and the hot spots in the container may cause substantial overheating and/or charring of the construct. By way of example, FIG. 1A depicts a top plan view of an exemplary microwave heating construct (e.g., a tray) 100 formed at least partially from a generally disposable material, for example, paper, paperboard, and/or polymeric materials.

The tray 100 includes a substantially oval base 102, a substantially upstanding wall 104 extending upwardly from the base 102, and a cavity 106 for receiving a food item generally defined by the base 102 and wall 104. The uppermost portion of the wall 104 comprises a rim 108. A microwave energy shielding element 110 overlies a portion of the base 102 and extends upwardly along the wall 104 a substantially uniform distance (e.g., height H) from the base 102, as shown schematically by stippling in FIG. 1B. In this and other embodiments, the microwave energy shielding element 110 generally comprises a metallic foil or high optical density material operative for reflecting substantially all of impinging microwave energy. The shielding element 110 circumscribes (i.e., surrounds) a plurality of elongate, somewhat reniform (i.e., kidney bean shaped) microwave energy transparent areas 112 and substantially obround microwave energy transparent areas 114 respectively disposed along the corners 116 and sides 118 of the tray 100. The microwave energy transparent areas 112, 114 comprise apertures in the microwave energy shielding element 110.

The present inventors have determined that when the tray 100 is heated under no load conditions (i.e., without a food item) in a microwave oven, the tray 100 may tend to overheat and char in the corners 116 of the tray 100 in the areas A adjacent to the shielding element 110. Even more significant charring may occur when the tray 100 is heated under no load conditions in a microwave oven having a single mode with one of the corners 116 positioned in the hot spot of the microwave oven and/or when the tray 100 is heated in a microwave oven without a turntable. Such charring also may occur when a food item is contained in the tray, which may cause overheating and/or overdrying of the adjacent portions of the food item.

Accordingly, there is a need for a method of reducing hot spots in a microwave heating container. There is also a need for a microwave heating container that mitigates the adverse effects of hot spots in a microwave oven. There also is further a need for a container that is capable of being heated in a single operating mode microwave oven and/or a microwave oven without a turntable without being prone to substantial charring.

Other features, aspects, and embodiments of the invention will be apparent from the following description, accompanying figures, and appended claims.

SUMMARY

This disclosure is directed to various microwave heating containers or constructs, is for forming such constructs, and methods for forming such blanks and constructs. The constructs may be formed partially from a generally disposable material, for example, paper, paperboard, and/or one or more polymeric materials. The constructs include one or more microwave energy shielding elements comprising a metal foil or high optical density material operative for reflecting substantially all of impinging microwave energy. Each microwave energy shielding element may be shaped or contoured as needed to minimize hot spots in the container and/or to mitigate the effect of hot spots in the microwave oven, thereby reducing charring of the construct and the adjacent food item.

In one example, the construct includes a base, a wall, and a microwave energy shielding element overlying at least a portion of the wall. The upper edge of the microwave energy shielding element is curved downwardly towards the base in the area(s) prone to charring. While not wishing to be bound by theory, it is believed that the incurved portion(s) of the microwave energy shielding element reduces the field strength and redistributes the power to other areas of the shielding element, thereby reducing the potential for overheating as compared with a microwave energy shielding element without such incurved portions.

Various other features, aspects, and embodiments of the present invention will be apparent from the following description and accompanying figures.

BRIEF DESCRIPTION OF THE DRAWINGS

The description refers to the accompanying drawings in which like reference characters refer to like parts throughout the several views, and in which.

DESCRIPTION

This disclosure is directed to a method of reducing hot spots in a microwave heating construct (e.g., tray or other container). This disclosure is also directed to a method of mitigating the effects of hot spots in a microwave oven. This disclosure is further directed to a microwave heating construct having features that reduce the presence of hot spots in the container and/or mitigate the effects of hot spots in a microwave oven. In accordance with one aspect of the disclosure, the overheating and/or charring experienced with some microwave energy interactive constructs can be significantly reduced or prevented by modifying the shape and/or dimensions of the microwave energy interactive element(s) in the construct.

Figure 1A:
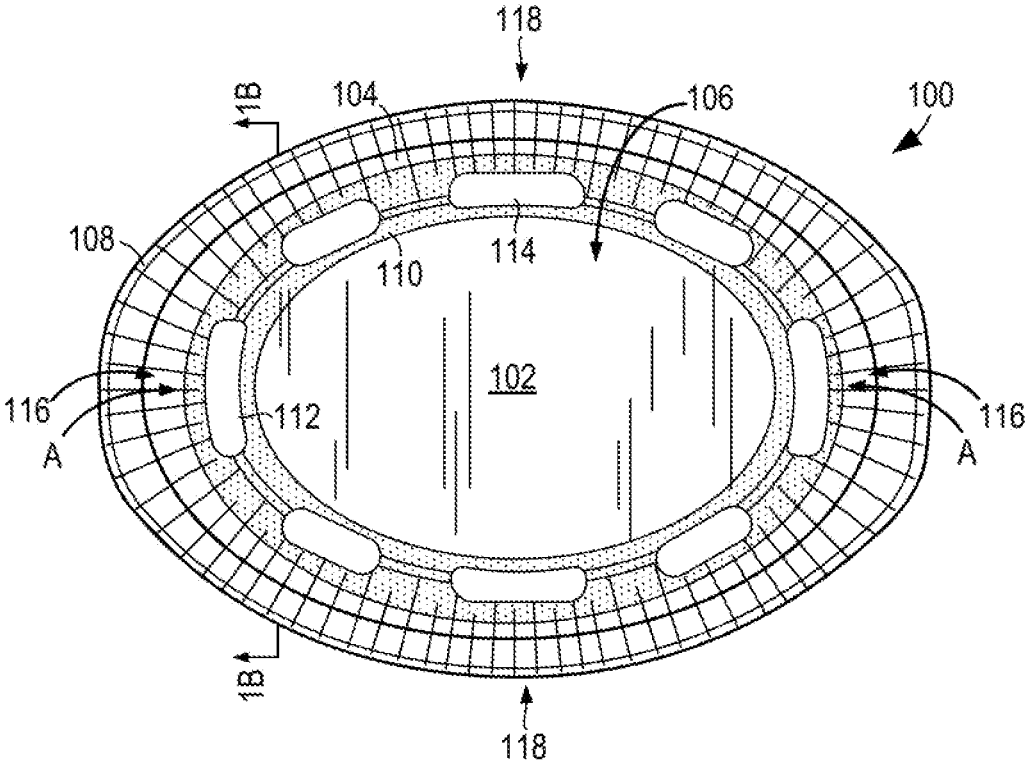
FIG. 1A depicts a top plan view of an exemplary microwave heating construct that is prone to charring in a microwave oven.
Figure 1B:
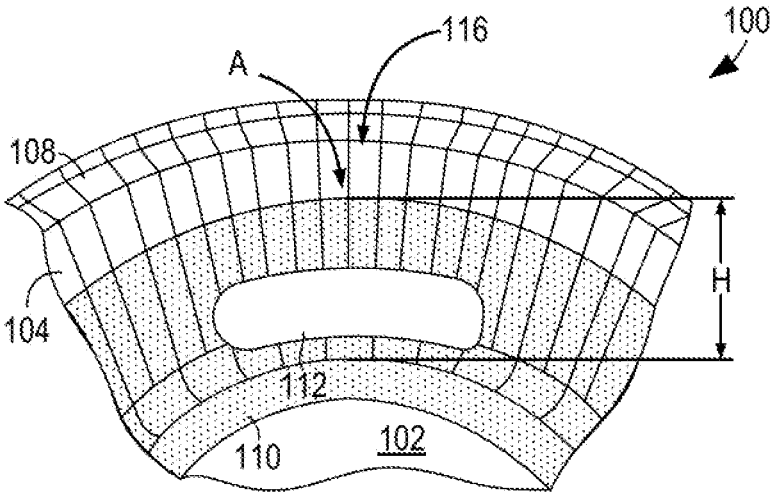
FIG. 1B depicts a partial end view of the construct of FIG. 1A, viewed along a line 1B-1B.
Figure 2A:
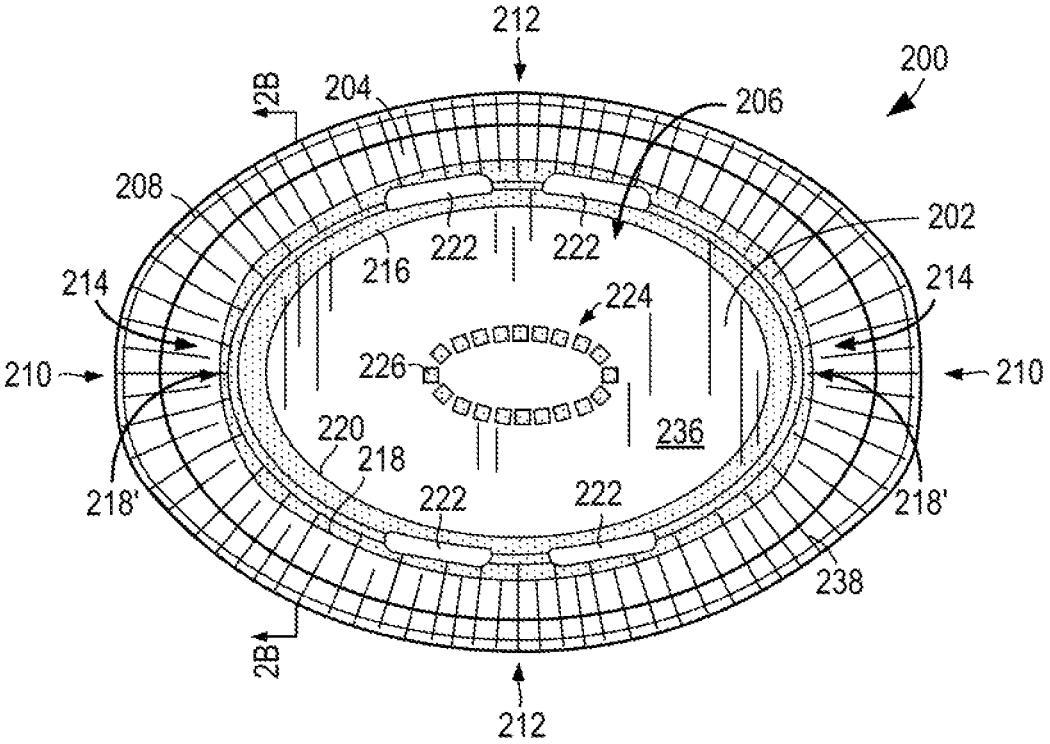
FIG. 2A depicts a top plan view of a microwave heating construct according to various aspects of the disclosure.
Figure 2B:
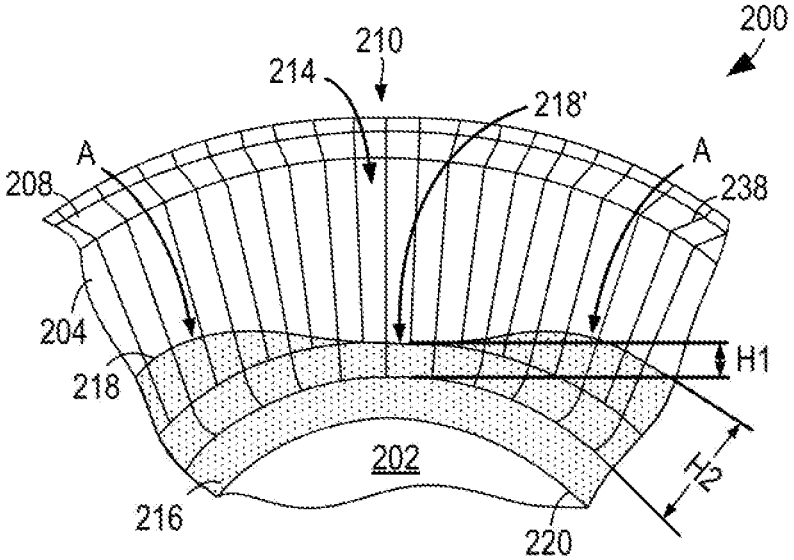
FIG. 2B depicts a partial end view of the microwave heating construct of FIG. 2A, viewed along a line 2B-2B.
Figure 2C:
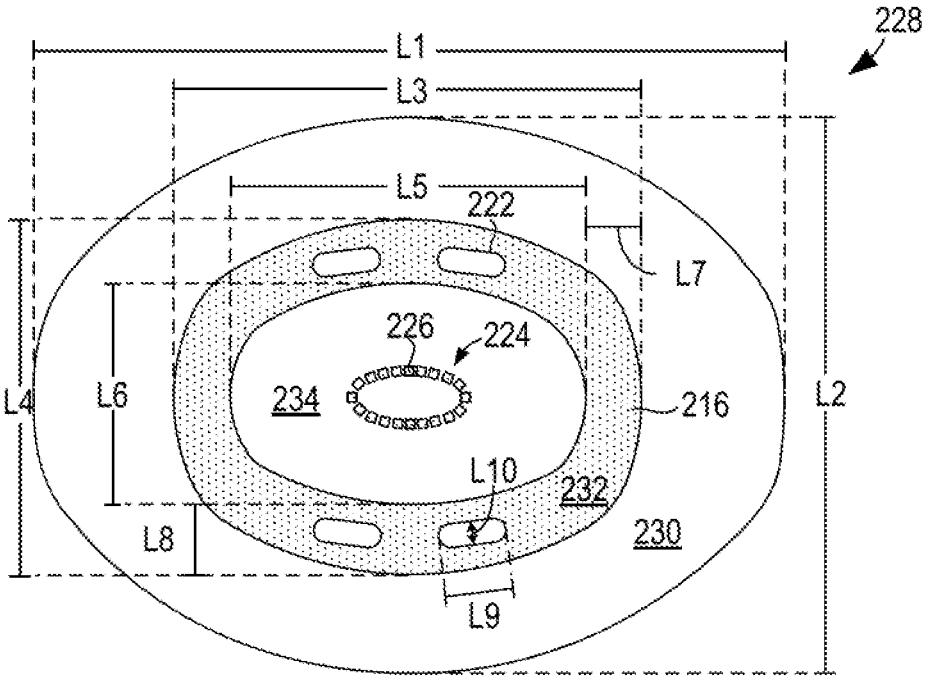
FIG. 2C schematically depicts a top plan view of an exemplary blank that may be used to form the construct of FIG. 2A.
Figure 3:
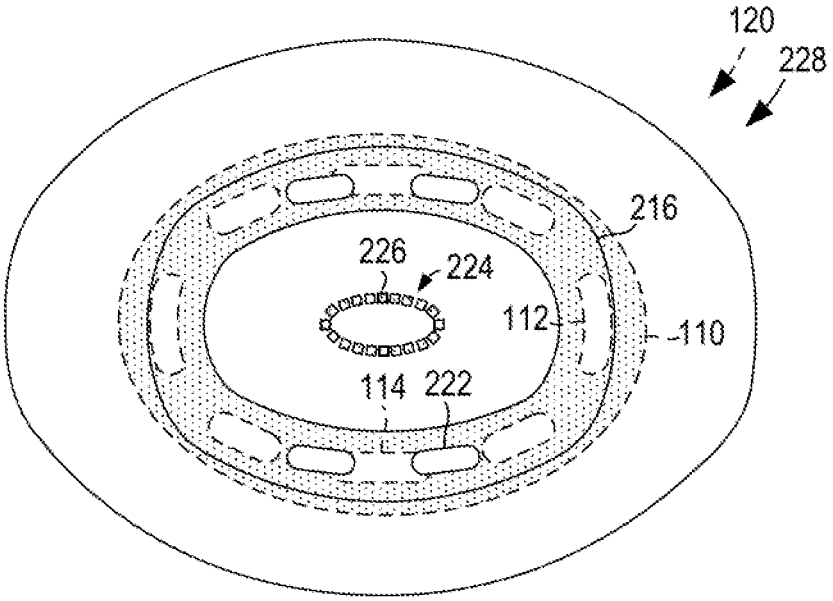
FIG. 3 schematically depicts a top plan view of the blanks of FIGS. 1C and 2C superimposed with one another for comparative purposes.

Various aspects of the disclosure may be illustrated by referring to FIGS. 2A-3, in which the present construct is compared with the construct of FIGS. 1A and 1B. It will be understood that although particular examples of microwave heating containers and blanks are shown herein, the teachings of the present disclosure may be used to modify and/or design numerous other shapes of constructs that experience significant charring due to the presence of hot spots or for any other reason.

FIG. 2A schematically illustrates a top plan view of an exemplary microwave heating construct 200 (e.g., container or tray) according to the present disclosure. The construct 200 includes a base 202 and a substantially upstanding wall 204 extending upwardly around the base 202 for defining a cavity or interior space 206 for receiving a food item. The uppermost portion of the wall 204 may comprise a rim 208.

The construct 200 is generally elongate in shape (e.g., oval, elliptical, obround, etc.), such that the construct 200 generally includes a pair of ends 210 opposite one another and a pair of opposed lengthwise portions 212 (or side portions) between the ends 210. The base 202 and wall 204 likewise have corresponding ends or end portions and lengthwise side portions or sides (not separately labeled in the figures), with the ends of the lengthwise portions 212 of the wall 204 generally meeting at and defining corners 214 of the construct 200. However, it will be appreciated that with a construct having an at least partially curvilinear shape, it will be difficult to discern precise boundaries between the various end portions and side portions of the base and wall and the corners of the construct, and therefore, such terms are used merely to discuss the relative positions of features, and not to limit the invention in any manner. Further, it will be appreciated that the lengthwise portions 212 of the wall 204 could be characterized as individual walls that meet at and define the corners 214 of the tray 200.

As shown schematically with stippling in FIGS. 2A and 2B, a microwave energy shielding element 216 overlies and/or is mounted or joined to a lower margin of the wall 204. In this example, the microwave energy shielding element 216 is disposed on an interior side of the wall 204 facing the interior space 206, but it is contemplated that the shielding element 216 may be on the exterior side of the wall 204.

The microwave energy shielding element 216 includes an upper edge 218 that is substantially uniform along the wall 204, except that the upper edge 218 includes a substantially incurved or incurvate portion 218' that extends downwardly towards the base 202 in each corner 214 of the construct 200, such that the height H1 of the shielding element 216 in the corners 214 of the tray 200 is less than the height H2 of the shielding element 216 along the remaining portions of the wall 204. The present inventors have found that by configuring the shielding element 216 in this manner, charring of the tray 200 is substantially reduced (as compared with tray 100), even when the tray 200 is used in a microwave oven without a turntable or in a single operating mode microwave oven with one of the ends placed in the hot spot of the microwave oven. While not wishing to be bound by theory, it is believed that reducing the height of the shielding element 216 reduces the field strength along the respective portions of the shielding element 216 to minimize overheating of the construct 200, as compared with a microwave energy shielding element without the incurved portions 218'. Further, it is believed that the energy of the hot spot of the microwave oven may be distributed to other areas of the shielding element 216. For example, the energy of the hot spot may be apportioned to the areas A adjacent to the incurved portions 218' of the shielding element 216, such that any overheating of such areas A is typically minimal. Other possibilities are contemplated.

If some cases, the microwave energy shielding element 216 may further overlie a peripheral margin of the base 202, as shown in FIGS. 2A and 2B. In some of such embodiments, the microwave energy shielding element 216 may have an uppermost edge 218 extending along a lower margin of the wall 204 and a lowermost edge 220 extending along peripheral margin of the base 202, with the uppermost edge 218 of the microwave energy shielding element 216 including the downwardly curved or incurvate portion 218' at each end 210 of the construct 200.

If desired, the shielding element 216 may circumscribe (i.e., surround or enclose) one or more microwave energy transparent areas 222 that allow microwave energy to be transmitted through the container for bulk heating of the food item. In some instances, the microwave energy transparent areas 222 may comprise apertures extending through the thickness of the microwave energy shielding element 216. In this example, the construct 200 includes a first pair of microwave energy transparent areas and a second pair of microwave energy transparent areas 222 in an opposed configuration on opposite lengthwise portions 212 of the construct 200, extending along the transitional area or "boundary" between the base 202 and the wall 204 (such that the microwave energy transparent areas 222 overlie both the base 202 and the wall 204). The microwave energy transparent areas 222 have a generally curvilinear shape, and more particularly, the microwave energy transparent areas have a generally elongate shape (e.g., obround, elliptical, oval, reniform (i.e., kidney bean shaped)). However, each of the microwave energy transparent areas 222 may be shaped, dimensioned, and/or configured within the tray 200 as needed to transmit a sufficient amount of microwave energy for bulk heating of the food item. Further, any number of microwave energy transparent areas may be used, and in some embodiments, the microwave energy transparent areas may be omitted.

Further, it is noted that in the construct 200 of FIGS. 2A and 2B, the shielding element 216 may have a generally reduced height H2 (as measured from the base 202) relative to the height H of the shielding element 110 of tray 100 (FIG. 1A). Thus, the overall area, and therefore reflective capacity, of shielding element 216 may generally be less than that of shielding element 110. As a result, some areas of the food item, for example, the upper portions of the food item adjacent to the wall 204 (where the shielding element has been omitted in the tray 200 of FIG. 1A), may heat more quickly in tray 200 than in tray 100. Accordingly, it will be appreciated that one or more microwave energy transparent areas may need to be added or omitted, and/or repositioned, reshaped, and/or resized to attain the desired degree of bulk heating for a particular food item in a particular container. For example, in the embodiment of FIG. 2A, the transparent areas 112 of tray 100 are omitted to provide additional shielding within the corners 214 of the tray 200. Further, the construct 200 includes only four microwave energy transparent areas 222 along the sides of the tray 200, as compared with the six transparent areas 114 used in tray 100. However, numerous other possible arrangements and modifications are contemplated.

Further, if needed or desired, other microwave energy interactive elements may be included or omitted from the tray to increase or decrease the respective rate of heating of other areas of the food item proportionally so the food item is heated more evenly during the desired microwave heating cycle (i.e., time). In this example, the tray 200 includes a microwave energy directing element 224 overlying the base 202. The microwave energy directing element 224 generally comprises a plurality of metallic foil segments 226 arranged in a loop. The loop may be dimensioned to induce the resonance of microwave energy. In this example, the microwave energy directing element 224 is substantially elongate (e.g., oval) in shape and substantially centered on the base 202, such that the microwave energy directing element 224 is operative for directing microwave energy towards a center of the base 202. However, differently configured microwave energy drawing elements may be used, as needed for a particular heating application.

To use the construct 200, a food item is placed in the interior space 206 and heated in a microwave oven. The microwave energy shielding element 216 reflects substantially all of the microwave energy impinging thereon, while the upper portion of the wall 204 not covered by the microwave energy shielding element 216, the portion of the base 202 not covered by the microwave energy directing element 226, and the microwave energy transparent areas 222 allow microwave energy to pass through the container 200 to heat the food item. The microwave energy directing element 226 assists with directing microwave energy to the center of the bottom of the food item, which might otherwise be prone to underheating. The present inventors have determined that the exemplary combination and arrangement of microwave energy interactive elements 216, 226 and microwave energy transparent areas (i.e., the areas not covered by microwave energy interactive elements 216, 226, including microwave energy transparent areas 222) of FIGS. 2A and 2B, and numerous other combinations contemplated hereby, may provide even heating of a food item without excessive charring of the food item or the construct, even when used in a single operating mode microwave oven.

To design or make a construct according to one method of the disclosure, a construct including a conventional microwave energy shielding element may be evaluated to determine which area(s) of the construct are prone to overheating. Such areas may lie within corners of the construct or along other portions of the wall(s). The dimensions of the microwave energy shielding element then may be reduced as needed in the identified areas of the construct. For example, the upper edge of the identified area may be curved downwardly towards the base of the construct to reduce the height of the shielding element, and therefore the resulting field strength, in the respective area, for example, as shown in FIG. 2B. If needed, the overall dimensions (e.g., height) of the microwave energy shielding element and the number, shape, and location of any microwave energy transparent areas may be adjusted to achieve the desired level of heating of the food item. Further, if needed, one or more additional microwave energy interactive elements may be incorporated into the construct to provide additional heating, browning, and/or crisping of the food item.

FIG. 2C schematically depicts a top plan view of an exemplary blank 228 for forming the construct of FIGS. 2A and 2B. The blank 228 generally includes a peripheral region 230, a medial region 232, and a central region 234. In this example, the peripheral region 230 is substantially transparent to microwave energy. The medial region 232 comprises a microwave energy shielding element 216 (schematically illustrated by stippling) having a generally elongate, annular shape with somewhat flattened ends, and a plurality of microwave energy transparent areas 222 surrounded or circumscribed by the microwave energy shielding element 216. The microwave energy transparent areas 222 may have any suitable shape and configuration, as described above, and in some examples, may have a curvilinear shape. The central region 234 includes a plurality of metallic segments 226 arranged to form an elongate loop 224 that may serve as a microwave energy distributing element in the construct 200 formed from the blank 228. The remainder of the central region 234 may be transparent to microwave energy. When formed into the construct 200 of FIGS. 2A and 2B, the peripheral region 230 and part of the medial region 232 define the wall 204 (with the outermost portion of the peripheral region 230 defining the rim 208), and the remainder of the medial region 232 and the central region 234 define the base 202.

For purposes of illustration, and not limitation, exemplary approximate dimensions of the blank 228 may be as follows: L1=260 mm; L2=193 mm; L3=160 mm; L4=124 mm; L5=123 mm; L6=78 mm; L7=19 mm; L8=23 mm; L9=24 mm; and L10=8.5 mm.

Figure 1C:
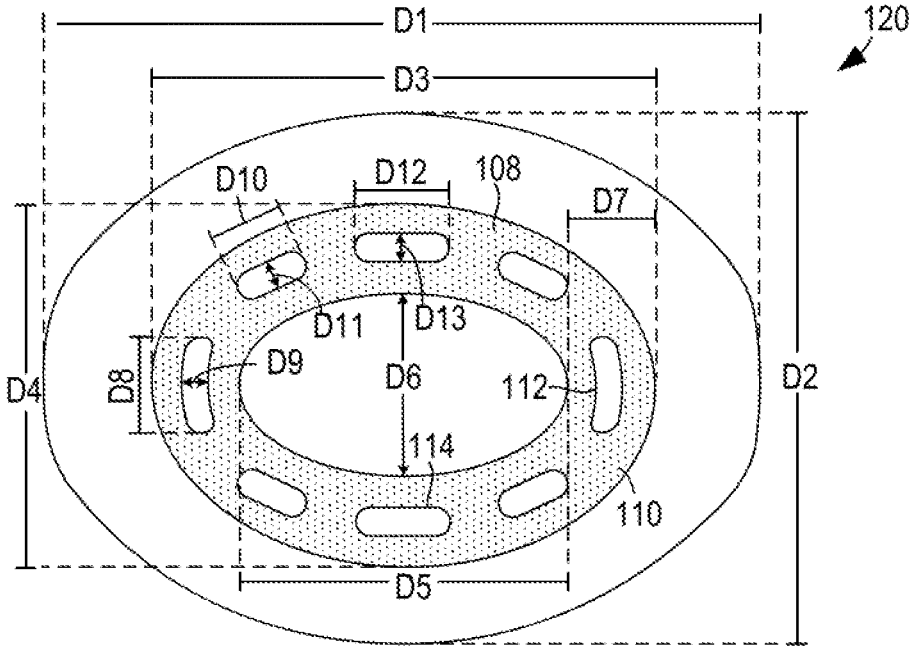
FIG. 1C schematically depicts a top plan view of an exemplary blank that may be used to form the construct of FIG. 1A.

By way of comparison, FIG. 1C schematically depicts a top plan view of an exemplary blank 120 for forming the construct of FIGS. 1A and 1B. In this example, the microwave energy shielding element has an elongate annular shape. For purposes of illustration, exemplary approximate dimensions of the blank may be as follows: D1=260 mm;

D2=193 mm; D3=182 mm; D4=131 mm; D5=119 mm; D6=69 mm; D7=31 mm; D8=35 mm; D9=10 mm; D10=24 mm; D11=9 mm; D12=35 mm; and D13=10 mm.

For further comparison, FIG. 3 schematically illustrates the blanks 120, 228 of FIGS. 1C and 2C in a superimposed configuration, with various features of the blank of FIG. 1C being shown with dashed lines and the blank of FIG. 2C being shown with solid lines.

Numerous other microwave heating constructs are encompassed by this disclosure. The constructs may have any shape, dimensions, and combination of microwave energy interactive elements. For example, although a somewhat oval construct with rounded ends is illustrated, other constructs may have the shape of a circle, obround, triangle, square, rectangle, pentagon, hexagon, heptagon, octagon, or any other suitable regular or irregular shape. Such constructs may have no distinct corners (e.g., as with a circle, which may be characterized as having no distinct corners or as comprising a continuous arrangement of corners), or may have one or more distinct corners, as with a triangle, square, or numerous other shapes. Any of such corners may be rounded in shape, and the degree of rounding (i.e., the radius of curvature) may vary for each application. Likewise, any of such constructs may have any suitable number of walls between the corners, and such walls may be substantially straight, curved, or any combination thereof. Accordingly, it will be appreciated that the location of the hot spot(s) (where present) may vary for each construct. For instance, although the illustrated construct includes hot spots at opposite ends of the construct in the corners, one or more hot spots alternately or additionally may be located along the walls or wall portions of the construct. Thus, the number and placement of incurved areas may likewise vary for each construct.

Any of such constructs may be formed from various materials, provided that the materials are substantially resistant to softening, scorching, combusting, or degrading at typical microwave oven heating temperatures, for example, at from about 250° F. to about 425° F. The materials may include microwave energy interactive materials, for example, those used to form microwave energy shielding elements and other microwave energy interactive elements, and microwave energy transparent or inactive materials, for example, those used to form the remainder of the construct.

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

The microwave energy interactive material may be used to form one or more microwave energy interactive elements or features that alter the effect of microwave energy during the heating or cooking of the food item. Such elements or features may shield a particular area of the food item from microwave energy, may direct microwave energy towards or away from a particular area of the food item, or may promote browning and/or crisping of a particular area of the food item. In doing so, the various elements reflect, absorb, or transmit microwave energy in various proportions to bring about a desired heating, browning, and/or crisping result.

In the examples illustrated schematically in FIGS. 1A-3, the microwave energy shielding elements 110, 216 may comprise a foil or high optical density evaporated material having a thickness sufficient to reflect a substantial portion of impinging microwave energy. Such elements are typically formed from a conductive, reflective metal or metal alloy, for example, aluminum, copper, or stainless steel, in the form of a solid "patch" generally having a thickness of from about 0.000285 inches to about 0.05 inches, for example, from about 0.0003 inches to about 0.03 inches. Other such elements may have a thickness of from about 0.00035 inches to about 0.020 inches, for example, 0.016 inches.

Microwave energy reflecting elements may be configured in various ways, depending on the particular application for which the element is used. Larger microwave energy reflecting elements, for example, shielding element 110, 216 may be used where the food item is prone to scorching or drying out during heating, while smaller microwave energy reflecting elements (not shown) may be used to diffuse or lessen the intensity of microwave energy. A plurality of smaller microwave energy reflecting elements, for example, elements or segments 226, also may be arranged to form a microwave energy directing element, for example, microwave energy directing element 224, to direct microwave energy to specific areas of the food item, for example, the center of the bottom of the food item. If desired, the loops may be of a length that causes microwave energy to resonate, thereby enhancing the distribution effect. While one particular microwave energy distributing element is illustrated herein, it will be understood that numerous other patterns and configuration of segments are contemplated hereby. Examples of other microwave energy distributing elements are described in U.S. Pat. Nos. 6,204,492, 6,433,322, 6,552,315, and 6,677,563.

Although particular examples of microwave energy interactive elements are illustrated in FIGS. 1A-3, it will be understood that other microwave energy interactive elements (not shown) may be used. For example, the construct or blank may include a thin layer of microwave interactive material (generally less than about 100 angstroms in thickness, for example, from about 60 to about 100 angstroms in thickness, and having an optical density of from about 0.15 to about 0.35, for example, about 0.21 to about 0.28) that tends to absorb at least a portion of impinging microwave energy and convert it to thermal energy (i.e., heat) at the interface with a food item. Such elements often are used to promote browning and/or crisping of the surface of a food item. When supported on a film or other substrate, such an element may be referred to as a "susceptor film" or sometimes, simply, "susceptor".

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy therethrough, for example, as discussed above in connection with microwave energy transparent areas 112, 114, 222. The breaks or apertures may be sized and positioned to heat particular areas of the food item selectively. The breaks or apertures may extend through the entire structure, or only through one or more layers. The number, shape, size, and positioning of such breaks or apertures may vary for a particular application depending on the type of construct being formed, the food item to be heated therein or thereon, the desired degree of shielding, bulk heating, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void in one or more layers or materials used to form the construct, or may be a non-physical "aperture". A non-physical aperture is a microwave energy transparent area that allows microwave energy to pass through the structure without an actual void or hole cut through the structure. Such areas may be formed by simply not applying microwave energy interactive material to the particular area, or by removing microwave energy interactive material in the particular area, or by mechanically deactivating the particular area (rendering the area electrically discontinuous). Alternatively, the areas may be formed by chemically deactivating the microwave energy interactive material in the particular area, thereby transforming the microwave energy interactive material in the area into a substance that is transparent to microwave energy (i.e., microwave energy inactive). While both physical and non-physical apertures allow the food item to be heated directly by the microwave energy, a physical aperture also provides a venting function to allow steam or other vapors to escape from the interior of the construct. The arrangement of microwave energy interactive and microwave energy transparent areas may be selected to provide various levels of heating, as needed or desired for a particular application.

The microwave energy interactive element may be supported on a microwave inactive or transparent substrate, for example, a polymer film or other suitable polymeric material (to form a microwave energy interactive "web"), for ease of handling and/or to prevent contact between the microwave energy interactive material and the food item. The outermost surface of the polymer film may define at least a portion of the food-contacting surface 236 of the container 200, as indicated in FIG. 2A. Examples of polymer films that may be suitable include, but are not limited to, polyolefins, polyesters, polyamides, polyimides, polysulfones, polyether ketones, cellophanes, or any combination thereof. In one particular example, the polymer film comprises polyethylene terephthalate. The thickness of the film generally may be from about 35 gauge to about 10 mil. In each of various examples, the thickness of the film may be from about 40 to about 80 gauge, from about 45 to about 50 gauge, about 48 gauge, or any other suitable thickness. Other non-conducting substrate materials such as paper and paper laminates, metal oxides, silicates, cellulosics, or any combination thereof, also may be used.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth.

The microwave interactive element or microwave interactive web may be joined to or overlie a dimensionally stable, microwave energy transparent support or base to form the construct. In one example, the support may comprise a polymer or polymeric material. As another example, the support may comprise a paperboard material, which may be cut into a blank prior to use in the construct. The paperboard may have a basis weight of from about 60 to about 330 lbs/ream (lbs/3000 sq. ft.), for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUSS board, commercially available from Graphic Packaging International.

In another aspect, where a more flexible construct is to be formed, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

It will be understood that with some combinations of elements and materials, the microwave energy interactive element(s) may have a grey or silver color that is visually distinguishable from the substrate or the support. However, in some instances, it may be desirable to provide a package having a uniform color and/or appearance. Such a package may be more aesthetically pleasing to a consumer, particularly when the consumer is accustomed to packages or containers having certain visual attributes, for example, a solid color, a particular pattern, and so on. Thus, for example, the present disclosure contemplates using a silver or grey toned adhesive to join the microwave energy interactive element to the support, using a silver or grey toned support to mask the presence of the silver or grey toned microwave energy interactive element, using a dark toned substrate, for example, a black toned substrate, to conceal the presence of the silver or grey toned microwave energy interactive element, overprinting the metallized side of the polymer film with a silver or grey toned ink to obscure the color variation, printing the non-metallized side of the polymer film with a silver or grey ink or other concealing color in a suitable pattern or as a solid color layer to mask or conceal the presence of the microwave energy interactive element, or any other suitable technique or combination of techniques.

The blank 228 may be formed into the tray 200 or other construct in any suitable manner including, but not limited to, various thermal, mechanical, or thermomechanical techniques or devices, or any combination of such techniques and/or devices. Some of such techniques may include press forming techniques, injection molding, adhesive bonding, thermal bonding, ultrasonic bonding, mechanical stitching, or any other suitable process. In the example illustrated in FIGS. 2A and 2B, the construct 200 may be formed using a press forming technique, thereby forming a plurality of creases, folds, and/or pleats 238 in the construct.

Further, any of the various components used to form the construct may be provided as a sheet of material, a roll of material, or a die cut material in the shape of the package to be formed (e.g., a blank). For example, as mentioned above, the microwave energy interactive elements 216, 224 may be part of a microwave interactive web (e.g., the microwave energy interactive elements 216, 224 may be supported on a polymer film). In this regard, the tray 200 may be formed by mounting such a microwave interactive web (e.g., which includes a polymer film that carries the microwave energy interactive element 216, 224) within, or otherwise to, a previously formed container (not shown), such as, but not limited to, a previously formed container (e.g., tray) formed from a polymer or polymeric material, as described in U.S. Patent Application Publication No. US 2007-0215611 A1, published Sep. 20, 2007. Also, FIG. 2C of the present application can be characterized as being at least substantially illustrative of an isolated plan view of such a microwave energy interactive web (e.g., which includes a polymer film that carries the microwave energy interactive elements 216, 224) that is in a flat configuration prior to mounting to the previously formed container. Generally described, the tray 200 may be formed in any acceptable manner.

While the present invention is described herein in detail in relation to specific aspects and embodiments, it is to be understood that this detailed description is only illustrative and exemplary of the present invention and is made merely for purposes of providing a full and enabling disclosure of the present invention and to set forth the best mode of practicing the invention known to the inventors at the time the invention was made. The detailed description set forth herein is illustrative only and is not intended, nor is to be construed, to limit the present invention or otherwise to exclude any such other embodiments, adaptations, variations, modifications, and equivalent arrangements of the present invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other. Further, various elements discussed with reference to the various embodiments may be interchanged to create entirely new embodiments coming within the scope of the present invention.

What is claimed is:

1. A method of forming a microwave heating construct, the method comprising:

obtaining a blank comprising a central region, a medial region adjacent the central region, a peripheral region adjacent the medial region, and a microwave energy shielding element in the medial region, the microwave energy shielding element has an outer edge;

positioning the central region to at least partially form a base of the microwave heating construct;

positioning the peripheral region and at least a portion of the medial region to form a wall extending upwardly from the base and extending around the base, a lower margin of the wall is positioned adjacent the base, the microwave energy shielding element overlying the lower margin of the wall and extending around the base, the outer edge of the microwave energy shielding element forms an upper edge of the microwave energy shielding element that includes a downwardly curved portion that curves downwardly toward the base and is positioned along the lower margin of the wall and proximate the base.

2. The method of claim 1, further comprising reducing the height of the microwave energy shielding element at the downwardly curved portion and locating the downwardly curved portion in an area of the microwave heating construct that is prone to overheating when exposed to microwave energy.

3. The method of claim 1, wherein the positioning the central region and the positioning the peripheral region comprise forming a cavity at least partially defined by the base and the wall, the cavity being for receiving a food item in the microwave heating construct.

4. The method of claim 3, wherein positioning the central region and the positioning the peripheral region comprise forming at least one corner of the microwave heating construct formed by the base and the wall, the downwardly curved portion of the of the microwave energy shielding element is positioned in the corner.

5. The method of claim 1, wherein the peripheral region is transparent to microwave energy.

6. The method of claim 1, wherein the microwave energy shielding element comprises an elongate annular shape with the outer edge having at least one flattened end.

7. The method of claim 1, wherein the blank comprises a paperboard support layer.

8. The method of claim 1, wherein the microwave energy shielding element is configured to reflect impinging microwave energy.

9. The method of claim 6, wherein the at least one flattened end of the outer edge corresponds to the downwardly curved portion in the microwave heating construct.

10. The method of claim 9, wherein the at least one flattened end of the outer edge comprises a first flattened end and a second flattened end, the downwardly curved portion comprises a first downwardly curved portion corresponding to the first flattened end and a second downwardly curved portion corresponding to the second flattened end.

11. The method of claim 6, wherein the central region is transparent to microwave energy at a portion of the central region that is adjacent an inner edge of the microwave energy shielding element.

12. A blank for forming a microwave heating construct, the blank comprising:

a central region for at least partially forming a base of the microwave heating construct, a medial region adjacent the central region, a peripheral region adjacent the medial region, the peripheral region and at least a portion of the medial region being for forming a wall extending upwardly around the base of the microwave heating construct, a lower margin of the wall is adjacent the base;

a microwave energy shielding element in the medial region, the microwave energy shielding element is for overlying the lower margin of the wall of the microwave heating construct and extending around the base of the microwave heating construct, the microwave energy shielding element has an outer edge that corresponds to an upper edge of the microwave energy shielding element in the microwave heating construct formed from the blank, the upper edge includes a downwardly curved portion that curves downwardly toward the base and is positioned along the lower margin of the wall and proximate to the base in the microwave heating construct formed from the blank.

13. The blank of claim 12, wherein the base and the wall define a cavity for receiving a food item in the microwave heating construct formed from the blank.

14. The blank of claim 13, wherein the base and the wall define at least one corner of the microwave heating construct formed from the blank, the downwardly curved portion of the of the microwave energy shielding element is positioned in the corner.

15. The method of claim 1, wherein the peripheral region is transparent to microwave energy.

16. The blank of claim 13, wherein the microwave energy shielding element comprises an elongate annular shape with the outer edge having at least one flattened end.

17. The blank of claim 14, wherein the blank comprises a paperboard support layer.

18. The blank of claim 15, wherein the microwave energy shielding element is configured to reflect impinging microwave energy.

19. The blank of claim 16, wherein the at least one flattened end of the outer edge corresponds to the downwardly curved portion in the microwave heating construct formed from the blank.

20. The blank of claim 19, wherein the at least one flattened end of the outer edge comprises a first flattened end and a second flattened end, the downwardly curved portion comprises a first downwardly curved portion corresponding to the first flattened end and a second downwardly curved portion corresponding to the second flattened end.

21. The blank of claim 16, wherein the central region is transparent to microwave energy at a portion of the central region that is adjacent an inner edge of the microwave energy shielding element.

* * * * *